US009670767B2

(12) United States Patent
Hernandez et al.

(10) Patent No.: US 9,670,767 B2
(45) Date of Patent: Jun. 6, 2017

(54) APPARATUS, SYSTEM AND METHODS FOR ALERTING OF ABNORMAL DRILLING CONDITIONS

(71) Applicants: Carlos A. Hernandez, Houston, TX (US); Ray E. Johnston, Austin, TX (US); Kelli M. Rettew, Houston, TX (US); Janice S. Mathew, Houston, TX (US); Steven J. Shipula, Conroe, TX (US); Tony Gomez, League City, TX (US)

(72) Inventors: Carlos A. Hernandez, Houston, TX (US); Ray E. Johnston, Austin, TX (US); Kelli M. Rettew, Houston, TX (US); Janice S. Mathew, Houston, TX (US); Steven J. Shipula, Conroe, TX (US); Tony Gomez, League City, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 159 days.

(21) Appl. No.: 14/550,643

(22) Filed: Nov. 21, 2014

(65) Prior Publication Data

US 2015/0235544 A1 Aug. 20, 2015

Related U.S. Application Data

(60) Provisional application No. 61/941,249, filed on Feb. 18, 2014.

(51) Int. Cl.
*E21B 44/00* (2006.01)
*E21B 7/00* (2006.01)

(52) U.S. Cl.
CPC ..... *E21B 44/00* (2013.01); *E21B 7/00* (2013.01)

(58) Field of Classification Search
CPC ..... E21B 44/00; E21B 49/005; E21B 7/00; E21B 44/005; E21B 47/022; E21B 21/08;
(Continued)

(56) References Cited

U.S. PATENT DOCUMENTS 8,705,318 B2 * 4/2014 Zheng ..... E21B 47/00 175/24
9,091,773 B1 * 7/2015 Selman ..... G01V 5/04
(Continued)

OTHER PUBLICATIONS

Arghad Arnout et al: "Drilling events detection using hybrid intelligent segmentation algorithm", Hybrid Intelligent Systems (HIS), 2012 12th International Conference On, IEEE, Dec. 4, 2012 (Dec. 4, 2012), pp. 508-511, XP032315842, DOI: 10.1109/HIS.2012.6421386 ISBN: 978-1-4673-5114-0 the whole document.
(Continued)

*Primary Examiner* — Hirdepal Singh
(74) *Attorney, Agent, or Firm* — King & Spalding LLP

(57) ABSTRACT

A method of monitoring drilling conditions includes acquiring raw data from drilling equipment and conditioning the raw data to generate conditioned data. Conditioning the raw data includes removing outlier data values and/or filtering out noise. The method further includes processing the conditioned data to generate output values. Processing the conditioned data includes determining a slope of a first set of data values of the conditioned data. The first set of data values correspond to a regression length of time. Processing the conditioned data further includes determining whether a difference between the slope of the first set of data values and a median slope determined over a median window of time exceeds a threshold. The method also includes generating an alarm based on the output values to indicate an abnormal drilling condition.

8 Claims, 8 Drawing Sheets

(58) Field of Classification Search
CPC ..... E21B 47/00; E21B 47/06; E21B 49/003; E21B 49/088; G06F 17/30; G06F 17/30398; G06F 17/30554; G06F 17/30572
USPC ..... 340/853.1
See application file for complete search history.

(56) References Cited

U.S. PATENT DOCUMENTS

2003/0220742 A1 11/2003 Niedermayr et al.
2004/0124012 A1* 7/2004 Dunlop ..... G06N 7/005 175/57
2010/0050017 A1* 2/2010 Almadi ..... G01V 11/002 714/15
2011/0220410 A1 9/2011 Aldred et al.
2012/0123756 A1* 5/2012 Wang ..... E21B 44/00 703/2
2013/0341090 A1* 12/2013 Zeineddine ..... E21B 7/00 175/24
2015/0134258 A1* 5/2015 Luppens ..... E21B 49/003 702/11
2015/0300151 A1* 10/2015 Mohaghegh ..... E21B 41/0007 702/9
2015/0308253 A1* 10/2015 Clark ..... E21B 33/085 175/24
2016/0003035 A1* 1/2016 Logan ..... E21B 47/12 340/854.6
2016/0237810 A1* 8/2016 Beaman, Jr. ..... E21B 47/10

OTHER PUBLICATIONS

R Wong et al.: "Advances in Real-Time Event Detection While Drilling", Mar. 7, 2013 (Mar. 7, 2013), XP055218411, Retreived from the internet: URL:https://www.onepetro.org/conference-paper/SPE-163515-MS?sort=&start=0&q=163515&from_year=&peer_reviewed=&published_between=&fromsearchresults=true&to_year=&rows=10# [retrieved on Oct. 6, 2015] p. 1-p. 2.
Adrian Ambrus et al: "Drilling Rig Sensor Data Validation in the Presence of Real-Time Process Variations", Oct. 2, 2013 (Oct. 2, 2013), XP055218414, Retreived from the internet: URL:https://www.onepetro.org/conference-paper/SPE-16387-MS?sort=&start=0&q=166387&from_year=&peer_reviewed=published_between=&fromsearchresults=true&to_year=&rows=10# [retrieved on Oct. 6, 2015] the whole document.
International Search Report for PCT/2015/011229 mailed on Oct. 16, 2015.

* cited by examiner

APPARATUS, SYSTEM AND METHODS FOR ALERTING OF ABNORMAL DRILLING CONDITIONS

CROSS-REFERENCE TO RELATED APPLICATIONS

The present application claims priority under 35 U.S.C. Section 119(e) to U.S. Provisional Patent Application No. 61/941,249, filed Feb. 18, 2014, and titled "Apparatus, System And Methods For Alerting Of Abnormal Drilling Conditions," the entire content of which is incorporated herein by reference.

FIELD OF THE INVENTION

The field of the invention relates to an apparatus, systems and methods for alerting of abnormal drilling conditions in the construction of wells in subterranean formations.

BACKGROUND

In oil/gas drilling operations, early detection of abnormal drilling conditions is important. For example, influx of pressurized hydrocarbons into a wellbore during the drilling of a well, referred to in the drilling industry as a "kick" is undesirable. An early detection of a kick is valuable in drilling operations.

During the drilling of subterranean wells, individual drilling parameters may often be reviewed by a drilling engineer. Generally, available systems display different drilling parameters separately, for example, for a drill engineer to analyze. While analysis of an individual drilling parameter is useful, a reliable analysis requires consideration of multiple drilling parameters. However, analysis of large amounts of separately presented data by one or more drill engineers can lead to unreliable and inconsistent decisions about abnormal drilling conditions. Thus, apparatus, systems and processes that provide alerts about abnormal drilling conditions based on trends and relationships between different drilling parameters are desirable.

SUMMARY

The invention comprises an apparatus, system and process for characterizing multiphase fluids in a fluid flow stream. In an example embodiment, a method of monitoring drilling conditions includes acquiring raw data from drilling equipment and conditioning the raw data to generate conditioned data. Conditioning the raw data includes removing outlier data values and/or filtering out noise. The method further includes processing the conditioned data to generate output values. Processing the conditioned data includes determining a slope of a first set of data values of the conditioned data. The first set of data values correspond to a regression length of time. Processing the conditioned data further includes determining whether a difference between the slope of the first set of data values and a median slope determined over a median window of time exceeds a threshold. The method also includes generating an alarm based on the output values to indicate an abnormal drilling condition.

In another example embodiment, a method of monitoring drilling conditions includes acquiring raw data from drilling equipment and conditioning the raw data to generate conditioned data. Conditioning the raw data includes removing outlier data values and/or filtering out noise. The method further includes processing the conditioned data to generate output values. Processing the conditioned data includes determining incremental changes in data values of the conditioned data and determining whether a sum of the incremental changes exceeds a threshold. The method further includes generating an alarm based on the output values to indicate an abnormal drilling condition.

In yet another example embodiment, a system for monitoring drilling conditions includes a raw data source to provide raw data related to a drilling by a drilling rig. The system further includes a data conditioning module to generate conditioned data by removing outlier data values and/or filtering out noise. The system also includes a data processor for processing the conditioned data to generate output values. The data processor determines incremental changes in data values of the conditioned data and whether a sum of the incremental changes exceeds a threshold. The system also includes an alarm generator to generate an alarm based on the output values to indicate an abnormal drilling condition.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and wherein.

Figure 1:
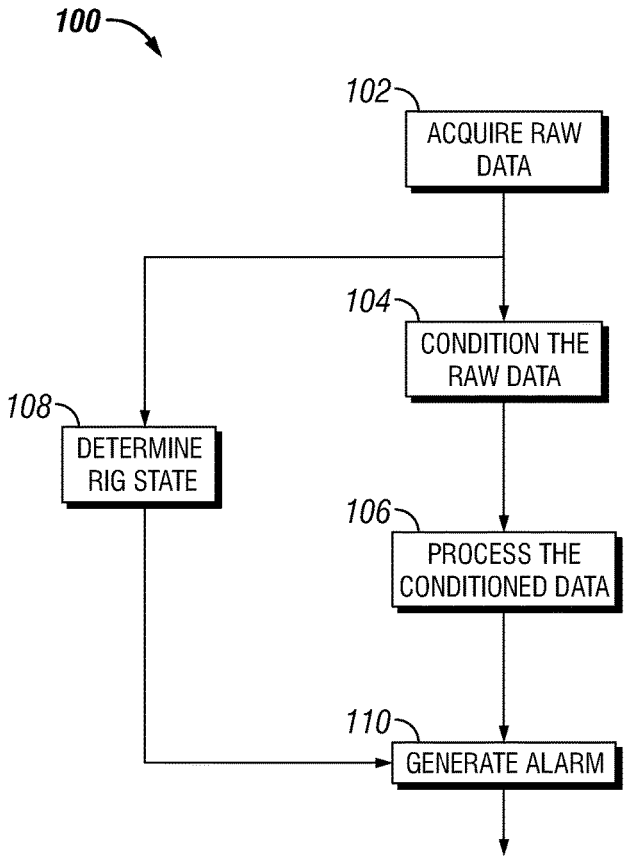
FIG. 1 illustrates a method of monitoring drilling conditions according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In general, early detection of abnormalities in drilling conditions is important in oil/gas drilling operations. For example, early detection of abnormal drilling conditions may allow timely corrective actions to be taken before the occurrence of unwanted events. A real time data stream may be analyzed to alert a drilling engineer to a potential change in a formation. For example, an alert may warn a drilling engineer about one or more parameters that are in an abnormal range in view of one or more other parameters well before a kick reaches the top of the wellbore. Alerts provided to a drilling engineer may lead to earlier corrective action such as changing wellbore trajectory through desirable hydrocarbon bearing zones in a formation. In general, alarms that indicate abnormal drilling conditions based on trend analysis of drilling parameters and causal relationships among drilling parameters may provide a valuable tool to a drilling engineer.

Now referring to the drawings, FIG. 1 illustrates a method 100 of monitoring drilling conditions according to an example embodiment. The method 100 is used to generate one or more alarms based on raw data that may be generated by drilling equipment such as sensors. In the method 100, functions may be implemented to determine data trends in individual data streams or data sets of the raw data representing different drilling related parameters.

In some example embodiments, the method 100 includes acquiring raw data at step 102. To illustrate, the raw data may include several parameters (e.g., different stream/sets of data representing different drilling related parameters) that are measured in real time during drilling. Some of the parameters may be related to each other such that a change in one parameter is linked to a change in another parameter. Examples of parameters that may be measured include stand pipe pressure (SPP), total strokes per minute (SPM), block position (BP), weight on bit (WOB), tank volume (TV), and flow out (FO). The raw data may include parallel streams of data representing the different parameters. Alternatively, the raw data may include serial streams of data representing the different parameters. In some example embodiments, the raw data may be received/acquired from a data server that acquires/receives the raw data from drilling equipment (e.g., sensors) that measure and/or determine the different parameters.

At step 104, the method 100 includes conditioning the raw data to generate conditioned data. Step 104 may be performed on some data streams (i.e., sets of data) of the raw data while other data streams (i.e., sets of data) of the raw data may be unaffected by conditioning the raw data at step 104. Conditioning of individual data streams or sets of data may be performed using signal processing methods.

In some example embodiments, generating the conditioned data includes performing an outlier removal process based on a median deviation of the raw data. In general, performing outlier removal removes unwanted and/or abnormal spikes in the raw data. To perform outlier removal at step 104, a median value of the raw data over a pre-defined moving window may first be determined. If a particular data value of the raw data is greater than the median value plus an outlier threshold value (e.g., user provided threshold value), the particular data value may be replaced with the median value.

In some example embodiments, noise removal is performed at step 104. For example, noise removal may be performed on the output of the outlier removal process. Alternatively, noise removal may be performed on the raw data without performing the outlier removal process. To illustrate, treating the raw data as signal streams, noise removal may be accomplished by performing a first order lag filtering on one or more signal streams to remove high frequency noise from the signal streams.

For example, a first order exponential filter may be used on a signal stream (before or after outlier removal) to pass the low frequency components and reducing the amplitude of signals with higher frequencies. The output of the filter depends on previous output value, current input value, the filter constant, and the time interval between two input values.

In some example embodiments, a deadband process is also performed at step 104 to reduce unwanted variations in the data by outputting only step changes. The deadband process may be performed on the output of the outlier removal process or the noise removal process or on the raw data.

In some example embodiments, one or more of the outlier removal, noise removal and deadband processes may be omitted at step 104. For example, one or more of the processes may be omitted for sets of data corresponding to some drilling parameters while two or all of the processes are performed on data sets corresponding to other drilling parameters. To illustrate, a deadband process may be performed without performing the outlier removal and the noise removal processes on some sets of data while all three processes may be performed at step 104 on other sets of data. In general, the last one of the processes performed in series at step 104 outputs the conditioned data.

At step 106, the method 100 includes processing the conditioned data generated at step 104 to generate output values for use in alarm generation. To illustrate, data trend and variation of the conditioned data over varying ranges of time may be analyzed to identify increasing, decreasing, and constant trends.

In some example embodiments, processing the conditioned data at step 106 may include performing a number of processes. For example, processing the conditioned data may include performing a first process that includes analyzing for changes in rates of change (increasing/decreasing/no change) over ranges of time. To illustrate, a slope process may be performed to determine (e.g., calculate) the slope of a set of data values of the conditioned data and to determine whether a difference between the slope of the set of data values and a median slope determined over a median window of time exceeds a threshold. To illustrate, the set of data values may correspond to a data stream of the raw data representing a drilling parameter (e.g., BP). If the difference between the two slopes is beyond the threshold and has been beyond the threshold for a period (for example, a time period defined by the user), the slope process indicates a change in slope with respect to the particular drilling parameter. The type of change, i.e., increase or decrease, is specified by the manner in which the threshold is exceeded.

In some example embodiments, processing the conditioned data at step 106 may include performing a second process/a value change process that includes analyzing for incremental changes (increasing/decreasing/no change) over ranges of time. The value change process includes determining incremental changes in data values of the conditioned data and determining whether a sum of the incremental changes exceeds a threshold. For example, the value change process may be performed on a set of data values corresponding to WOB. To illustrate, the value change process tracks incremental changes in a data stream (i.e., in a set of data values) of the conditioned data and determines if the total change is beyond a user defined threshold. If the total change is beyond the threshold, and has been beyond the threshold for a time period (e.g., a time period provided by the user), the value change process indicates a change in value in the data values. The type of change in value, increase or decrease, is specified by the manner in which the threshold is exceeded.

In some example embodiments, processing the conditioned data at step 106 may include performing a third process that includes estimating expected causal response in one set of data (corresponding to a drilling parameter) due to a change in another set of data (corresponding to another drilling parameter). For example, the third process may be an expected standing pipe pressure process that is performed to determine severity of a trend deviation in SPP with respect to variations in total SPM.

In some example embodiments, processing the conditioned data at step 106 may include performing a fourth process that includes estimating the rates of change of rates of change (i.e., estimating the derivative of acceleration with respect to time). To illustrate, an acceleration process may include determining (e.g., calculating) the rate of change of the current rate of change of data values of a particular parameter between two points in time.

In some example embodiments, processing the conditioned data at step 106 may include performing a lag time lookup process on causally related drilling parameters based on the corresponding sets of data. To illustrate, a lag time look-up formula may be used to determine the look-back time or lag time for a set of data values corresponding to a particular drilling parameter. For example, the lag time lookup process may be used to look back on the value changes of the total SPM parameter determined by performing the slope process or the value change process described above.

In some example embodiments, the method 100 includes determining a rig state at step 108. For example, determining a rig state includes determining whether a drilling rig is drilling and generating a rig state indicator value to indicate the rig state (i.e., drilling or not drilling). For example, the rig state may be determined based on data values in the raw data that indicate that a particular rig is drilling or not drilling. In some example embodiments, the particular data values may be different among different rigs.

At step 110, the method 100 further includes generating one or more alarms based on the outputs generated at step 106 to indicate one or more abnormal drilling conditions. For example, the alarms may be generated at step 110 by performing logical operations (such as true, false, greater than, less than, etc.) using outputs of the data processing operations at step 106, the rig state indicator value as well as other inputs such as end-user specified thresholds and data ranges. The alarms generated at step 110 will be transmitted in real-time and displayed so that early warning of abnormal conditions existing downhole can be provided to a drilling engineer.

As described above, the method 100 may be performed to provide the ability to create and/or display output alarms for abnormal drilling conditions based on trend analysis and causal relationships of basic drilling parameters subject to unexpected external forces. Such alarms can reliably alert drilling personnel of abnormal conditions.

Figure 2:
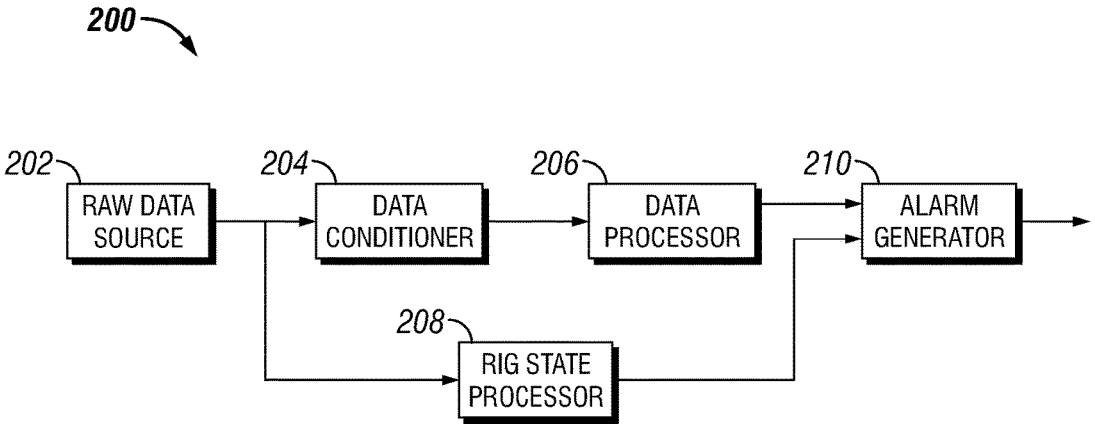
FIG. 2 illustrates a block diagram of a system for monitoring drilling conditions according to an example embodiment.

FIG. 2 illustrates a block diagram of a system 200 for monitoring drilling conditions according to an example embodiment. The system 200 includes a raw data source 202. The raw data source 202 provides raw data related to a drilling operation by a drilling rig. The raw data source 202 may be a real-time data source such as drilling equipment. For example, the raw data source 202 may include multiple sensors that measure drilling parameters such as SPP, total SPM, BP, WOB, TV, and FO. Each of the drilling parameters may be represented in the raw data by distinct data streams or one or more distinct sets of data. In some example embodiments, the raw data source 202 may include a data server that acquires/receives the raw data from drilling equipment such as sensors.

In some example embodiments, the system 200 includes a data conditioner 204. For example, the data conditioner 204 may be a signal processor that processes the signal representing the raw data from the raw data source 202. The data conditioner may perform the processes described above with respect to step 104 of the method 100 of FIG. 1. For example, the data conditioner 204 may remove outlier data values, filter out noise and perform a deadband operation as described with respect to step 104 of FIG. 1.

In some example embodiments, the system 200 includes a data processor 206. For example, the data processor 206 may be a microprocessor or a microcontroller. The data processor 206 may perform the processes described above with respect to step 106 of the method 100 of FIG. 1. For example, the data processor 204 may perform the first process described with respect to step 106 to analyze for changes in rates of change (increasing/ decreasing/no change) of data values over ranges of time. The data processor 204 may perform the value change process to analyze for incremental changes (increasing/decreasing/no change) of data values over ranges of time. The data processor 204 may also perform the third process described with respect to step 106 to estimate expected causal response in one set of data values (corresponding to a drilling parameter) due to a change in another set of data values (corresponding to another drilling parameter). The data processor 204 may further perform the fourth process described with respect to step 106 to estimate acceleration. In some example embodiments, the data processor 204 may also perform the lag time lookup process described above.

In some example embodiments, the system 200 includes a rig state generator 208. The rig state generator 208 determines whether a drilling rig is drilling and outputs a rig state indicator value to indicate the rig state (i.e., drilling or not drilling). For example, the rig state generator 208 may determine the rig state based on data values in the raw data that indicate that a particular rig is drilling or not drilling.

In some example embodiments, the system 200 includes an alarm generator 210. The alarm generator 210 outputs one or more alarms to indicate one or more abnormal drilling conditions. For example, the alarm generator 210 may be used to implement alarm generation described above with respect to step 110 of the method 100. The alarms generated by the alarm generator 210 may be transmitted in real-time or displayed so that early warning of abnormal conditions existing downhole can be provided to a drilling engineer. Such alarms can reliably alert drilling personnel of abnormal conditions as compared to alarms that are based on a single drilling parameter exceeding a threshold.

In some example embodiments, one or more of the components of the system 200 may be implemented in a single device. For example, the alarm generator 210 may be integrated into the data processor 206. Further, the data conditioner 204, the data processor 206, and the rig state processor 208, and the alarm generator 210 may be implemented using hardware (e.g., FPGA), software, or a combination of hardware and software.

Figure 3:
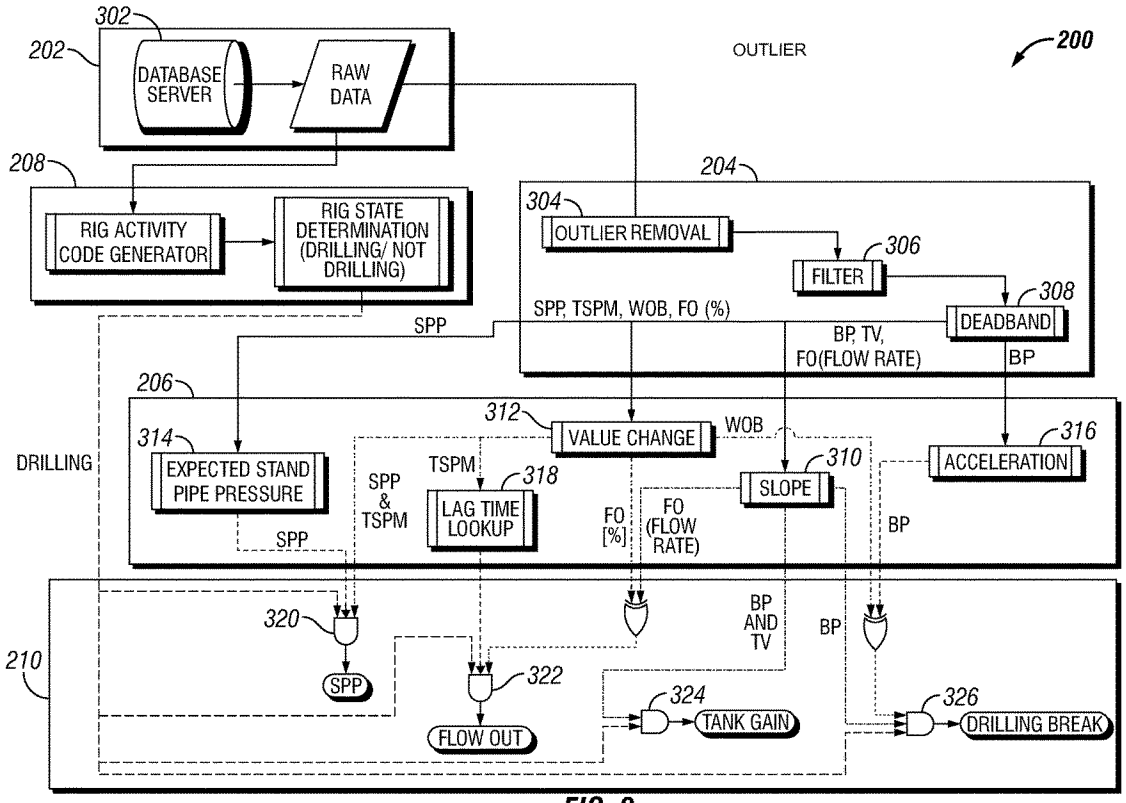
FIG. 3 illustrates details of the system of FIG. 2 according to an example embodiment.

FIG. 3 illustrates details of the system 200 of FIG. 2 according to an example embodiment. As illustrated in FIG. 2, the raw data source 202 may include a database server 302 that provides raw data to components of the system 200. For example, the database server 302 may acquire/receive the raw data from drilling equipment such as sensors. As described above, the raw data includes data streams or sets of data values that correspond to distinct drilling parameters such as SPP, total SPM, BP, WOB, TV, and FO.

The data conditioner 204 may receive the raw data from the raw data source 202 and perform conditioning of the raw data. In some example embodiments, the data conditioner 204 may be a signal processing device. As illustrated in FIG. 3, the data conditioner 204 may include an outlier removal module 304, a filter (i.e., noise removal) module 306, and a deadband module 308. Although the outlier removal module 304, the filter module 306, and the deadband module 308 are shown serially connected in FIG. 3, in alternative embodiments, one or more of the modules 304, 306, 308 may be omitted or bypassed.

In some example embodiments, the outlier removal module 304 performs the outlier removal process described with respect to step 104 of the method 100 to remove unwanted and/or abnormal spikes in the raw data. To perform outlier removal at step 104, a median value of the raw data over a pre-defined moving window may first be determined. If a particular data value of the raw data is greater than the median value plus an outlier threshold value (e.g., user provided threshold value), the particular data value may be replaced with the median value.

In some example embodiments, the filter module 306 performs the noise removal process described with respect to step 104 of the method 100. To illustrate, the filter module 306 may be a first order exponential filter that removes high frequency noise from signals corresponding to data streams of the raw data representing different drilling parameters. The output of the filter depends on previous output value, current input value, the filter constant, and the time interval between two input values. The operation of the filter module 306 may be described by Equation (1) below.

$$\text{output}_n=(1-\alpha)\cdot\text{input}_n+\alpha\cdot\text{output}_{n-1} \qquad \text{Equation (1)}$$

Where:

$$\alpha = \exp\left(-\frac{\Delta time}{\text{Filter Constant}}\right)$$

$\alpha$ is a constant between 0 and 1.

In Equation (1), $\text{output}_n$ equals the current output value; input, equals the current input value; and $\text{output}_{n-1}$ equals the previous output value.

In some example embodiments, the deadband module 308 reduces unwanted variations in the data by outputting only step changes. The deadband module 308 may operate on the output of the noise removal process as shown in FIG. 3. In alternative embodiments, the deadband module 308 may operate on the output of the outlier removal module 304 or the on the raw data. In some example embodiments, the deadband module 308 may be operated on all sets of data (of the raw data) corresponding to different drilling parameters. When the deadband module 308 is operated on a set of data values corresponding to a particular drilling parameter that should not be manipulated by the deadband module 308, the deadband module 308 may be operated with a deadband of 0, which effectively results in the particular set of data values being unaffected by the deadband module 308.

In some example embodiments, to reduce unwanted variations in a filtered set of data values corresponding to a particular drilling parameter (e.g., SPP), the deadband module 308 determines the median value of the filtered data over a pre-defined moving window and if a data value of the filtered set of data values falls within the median value +/− (i.e., plus or minus) a deadband threshold, the particular parameter is considered constant, and the output is set at the previous output value. If the data value of the filtered set of data values exceeds the deadband threshold, a change in trend of the data values of the particular filtered set of data values is considered to have occurred, and the output is set at the current median. The deadband module 308 may operate on other sets of data corresponding to other drilling parameters represented in the raw data in a similar manner.

Figure 4:
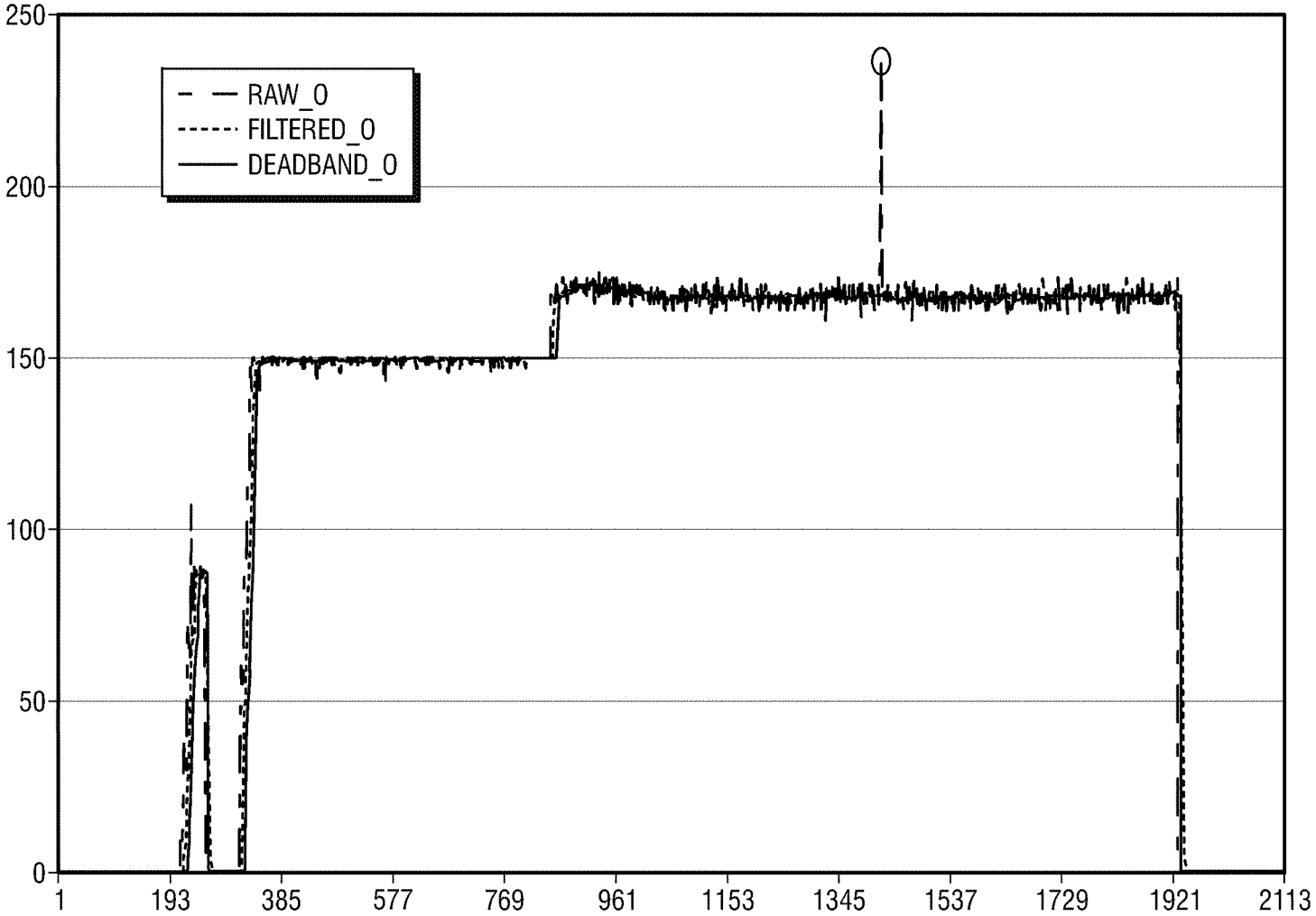
FIG. 4 illustrates a plot of output values of the data conditioner of FIG. 3 according to an example embodiment.

FIG. 4 illustrates a plot of output values of the data conditioner 204 according to an example embodiment. Referring to FIGS. 3 and 4, a spike is present in the curve representing a set of data values of the raw data that correspond to a particular drilling parameter (e.g., total SPM or TSPM) as shown in FIG. 4. As illustrated in FIG. 4, the plot output of the filter module 306 that operates on the output of the outlier removal module 304 does not have the spike and is less noisy than the curve of the set of data values of the raw data. Further, the plot of the output of the deadband module 308 is cleaner than the plot of the output of the filter module 306.

In some example embodiments, the data processor 206 may receive the output of the data conditioner 204 and generate outputs that are used in alarm generation by the alarm generator 210. In particular, the data processor 206 may receive the output of the deadband module 308. As illustrated in FIG. 3, the data processor 206 may include a slope module 310, a value change module 312, an expected SPP module 314, and an acceleration module 316. For example, the slope module 310 may analyze changes in rates of change (increasing/decreasing/no change) over ranges of time for BP, TV and FO (flow rate) drilling parameters represented by sets of data values in the output data from the data conditioner 204. The slope module 310 may perform the slope process of step 106 of the method 100 to determine (e.g., calculate) the slope of a set of data values of the conditioned data corresponding to a particular drilling parameter and to determine whether a difference between the slope of the set of data values and a median slope determined over a median window of time of data values corresponding to the particular drilling parameter exceeds a threshold (e.g., a user defined threshold).

To illustrate the operation of the slope module 310 in more detail, in some example embodiments, the slope module 310 calculates the slope of a set of data values corresponding to a particular drilling parameter and determines if the slope has changed beyond a user defined threshold. If the difference between the two slopes exceeds the threshold, and has been beyond the threshold for a period defined by a user, the slope module 310 outputs an indication of a change in slope. The type of change, i.e., increase or decrease, is specified by the manner in which the threshold has been exceeded. In some example embodiments, the inputs provided to the slope module 310 are the set of data values corresponding to a particular drilling parameter, a regression length of time, a median window for calculating a median slope value, an offset time, and an onset (time) window as well as user defined threshold. The slope module 310 may generate/store outputs including Slope Value (in unit of the particular parameter/second, an Offset Median Slope (in unit of the particular parameter/second), Slope Change Marker Increase (e.g., 1), Decrease (e.g., (−1), No Change (e.g., 0)), and timestamps associated with all stored outputs.

During operation, the slope module 310 calculates the slope of the data values using a linear regression according to Equation (2):

$$\text{slope} = \frac{\sum (x-\bar{x})(y-\bar{y})}{\sum (x-\bar{x})^2} \quad \text{Equation (2)}$$

In Equation (2), a. $\bar{x}$ is the average of associated x values, and $\bar{y}$ is the average of the associated y values.

b. x is time expressed in seconds. The number of seconds over which to calculate the slope is defined by the input value Regression Length.

c. y is a value of the set of data value expressed in units applicable to the particular drilling parameter.

d. The Regression Length indicates the number of values in the past to be used in the calculation. The current value will always be the most recent value in the calculation. That is, the slope module 310 will not wait for a future value to perform a calculation. Instead, the slope module 310 always looks at past values. For example, a Regression Length of 60 seconds means that all values between the current data value and the data value 60 seconds ago, inclusive, will be used in the calculation.

The slope module 310 also calculates a median Slope Value over the Median Window. To illustrate, median is defined herein as the middle value of a set of numbers, when the numbers are arranged from least to greatest. If number of values is even, the median is the average of the two values in the middle. The number of Slope Values over which to calculate the median value is defined by the Median Window, which indicates up to how many Slope Values in the past are to be used in the calculation. The current value will always be the most recent value in the calculation. That is, the slope module 310 will not wait for a future value to perform a calculation. Instead, the slope module 310 always looks at past values. For example, a Median Window of 60 seconds means that all Slope Values between the current value and the value 60 seconds ago, inclusive, will be used in the median determination.

The slope module 310 also determines the Offset Median Slope. The Offset Median Slope for the current timestamp is a Median Slope that was calculated in the past, as defined by the Offset. For example, if the current timestamp is 07:05:00, and the Offset is 60 seconds, then the Offset Median Slope associated with 07:05:00 is the Median Slope calculated at 07:04:00.

The slope module 310 may further calculate the difference (Delta) between the current Slope Value and the Offset Median Slope using Equation (3).

$$\text{Delta}=\text{Slope Value}-\text{Offset Median Slope} \quad \text{Equation (3)}$$

After determining the difference between the current Slope Value and the Offset Median Slope, the slope module 310 determines whether a Slope Change threshold has been reached. To illustrate, if Delta>=the Slope Change Threshold, the slope module 310 indicates that the slope change is an increase (e.g., 1). If Delta<=−1×Slope Change Threshold, the slope module 310 indicates that the slope change is a decrease (e.g., −1). Otherwise, the slope module 310 indicates there is no slope change (e.g., 0). In some example embodiments, the conversion of units may be required. For example, a unit of bbl/hr may need to be converted to bbl/second or vice versa.

After determining whether the Slope Change threshold has been reached, the slope module 310 may determine whether the Slope Change threshold has been continuously met over the Onset Window. If the Slope Change threshold has been continuously met over the Onset Window, the slope module 310 may output Slope Change Marker indicating an Increase, a Decrease, or No Change along with corresponding timestamps. To illustrate, if a slope change has been detected, the slope module 310 checks whether that same change has been detected continuously over a window defined by Onset Window. For example, if the current timestamp is 07:05:30, the Onset Window is equal to 30 seconds, and Slope Change equals "Increase," the slope module 310 checks whether Slope Change equals "Increase" for all timestamps between 07:05:00 and 07:05:30, inclusive and outputs a Slope Increase to indicate so. A similar operation is performed for when Slope Change equals "Decrease." In both cases, if Slope Change has not been a constant value in the Onset Window, the slope module 310 will not output a marker indicating a change in slope.

Figure 5:
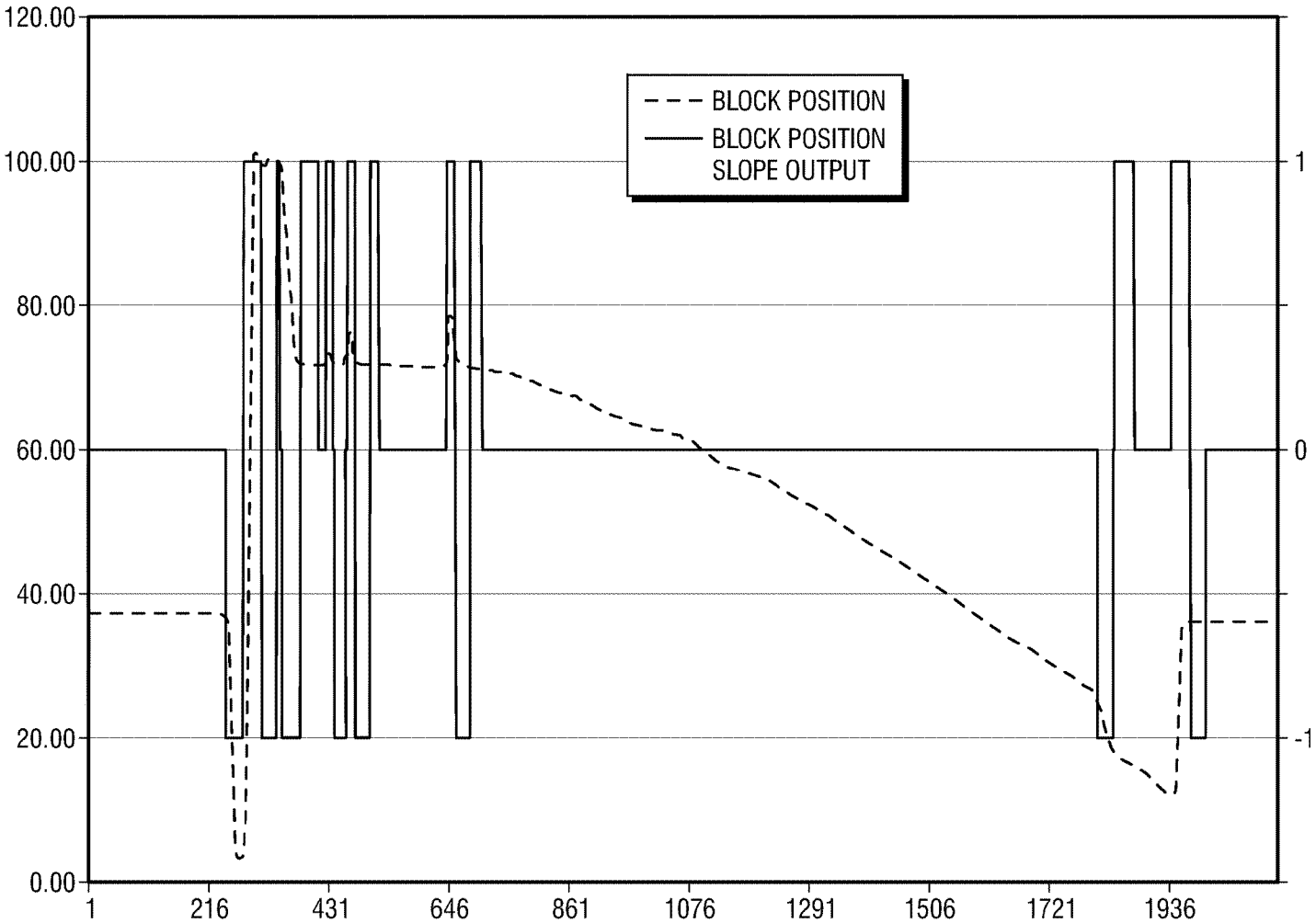
FIG. 5 illustrates a plot of output values of a slope module of the data processor of FIG. 3 according to an example embodiment.

FIG. 5 illustrates a plot of output values of the slope module 310 of the data processor of FIG. 3 according to an example embodiment. Referring to FIGS. 3 and 5, a curve representing data values of the BP (block position) parameter provided to the slope module 310 and a curve representing output values of the slope module 310 indicating change in slope determined as described above are shown. With respect to the output values of the slope module 310, a '1' indicates a slope increase, '−1' indicates a slope decrease, and a '0' indicates no change in slope indicating that slope variations over the end-user specified time interval are within the threshold. Although FIG. 5 illustrates a curve representing data values of the BP drilling parameter, similar curves may be plotted for other drilling parameters such as TV and FO (flow rate).

In some example embodiments, the value change module 312 of the data processor 206 analyzes incremental changes (increasing/decreasing/no change) over ranges of time for SPP, TSPM, WOB, and FO drilling parameters represented by sets of data values in the output data from the data conditioner 204. The value change module 312 may perform the value change process of step 106 of the method 100 to tracks the incremental changes of a set of data values corresponding to a drilling parameter and to determine if the total change is beyond a user defined threshold.

In some example embodiments, the value change module 312 performs a series of calculations and value comparisons to analyze incremental changes. If the total change is beyond the threshold, and has been beyond the threshold for a period defined by the user, the value change module 312 outputs a change in value. The type of change in value, i.e., increase or decrease, is specified by the manner in which the threshold has been exceeded.

In some example embodiments, the inputs provided to the value change module 312 are a set of data values corresponding to a particular drilling parameter, Onset Window, and Value Change Threshold provided by a user. The value change module 312 may generate/store outputs including Value Change Marker as Increase (e.g., 1), Decrease (e.g., (−1), No Change (e.g., 0)) and Timestamps associated with all stored outputs.

During operation, the value change module 312 determines the incremental change in the data values corresponding to a particular drilling parameter by calculating the difference (V-difference) between current data value and a previous data value of the data values corresponding to the particular drilling parameter. To determine the total the total change in the data values, the value change module 312 increments the total change (Sum) by V-difference if a previous Value Change Marker indicates No Change, and resets Sum to zero if a previous Value Change Marker indicates "Increase" or "Decrease. The value change module 312 also checks if Sum (the total change in the data values) has reached a threshold. To illustrate, if Sum >=Value Change Threshold, Value Change is set to "Increase." If Sum <=−1×Value Change Threshold, Value Change is set to "Decrease."

If a value change has been detected as indicated by Value Change, the value change module 312 determines whether the same change has been detected continuously over a time window defined by Onset Window. For example, if the current timestamp is 07:05:30, the Onset Window is equal to 30 seconds and Value Change equals "Increase," the value change module 312 checks whether Value Change equals "Increase" for all timestamps between 07:05:00 and 07:05:30, inclusive and outputs "Increase" to indicate so. A similar operation is performed when Value Change equals "Decrease." In both cases, if Value Change has not been a constant value in the Onset Window, the value change module 312 will not output a marker indicating a change in value.

Before a final indication of Value Change Marker as "Increase" (e.g., 1), "Decrease" (e.g., −1), or "No Change" (e.g., 0), the value change module 312 may check for persistence of the behavior after an initial marker to provide a final Value Change Marker. To illustrate, if a value change marker has occurred right before (n−1), then the value change module 312 checks for the current difference value to determine (1) if the difference value is >=0 for a previous increase marker and to output an increase marker if true; and (2) if the difference value is <=0 for a previous decrease marker and to output a decrease marker if true.

Figure 6:
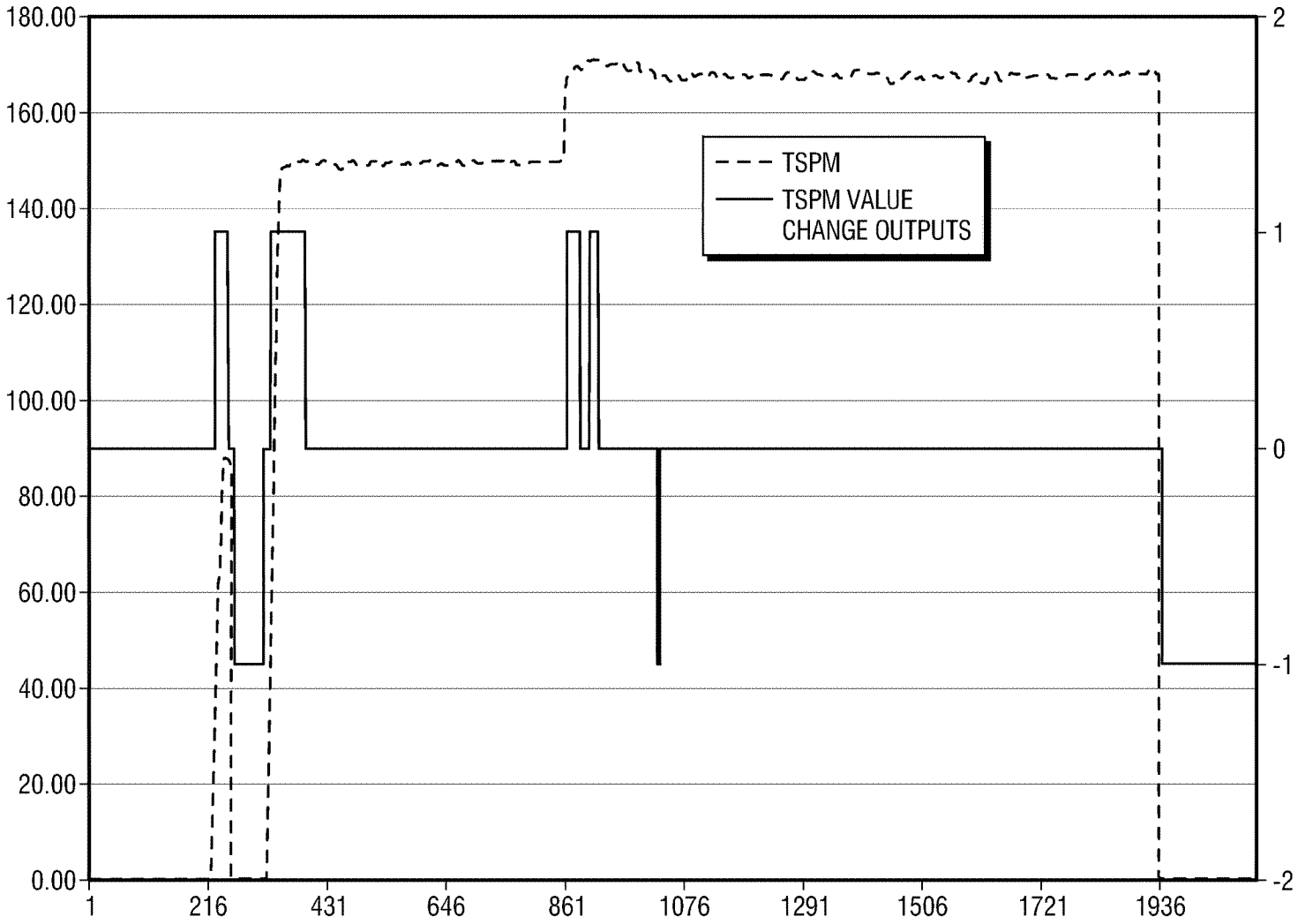
FIG. 6 illustrates a plot of outputs values of a value change module of the data processor of FIG. 3 according to an example embodiment.

FIG. 6 illustrates a plot of output values of the value change module 312 of the data processor 206 of FIG. 3 according to an example embodiment. Referring to FIGS. 3 and 6, a curve representing data values corresponding to TSPM parameter provided to the value change module 312 and a curve representing output values of the value change module 312 indicating change in value determined as described above are shown. In FIG. 6, a '1' indicates that the cumulative change in Value of TSPM over the end-user specified time interval has increased above the end-user specified threshold. A '−1' indicates that the cumulative change in Value of TSPM over the end-user specified time interval has Decreased below the end-user specified threshold. A '0' indicates that the cumulative change in Value of TSPM over the end-user specified time does not exceed the threshold.

In some example embodiments, the data processor 206 estimates expected causal response in one set of data values (corresponding to a drilling parameter) due to a change in another set of data values (corresponding to another drilling parameter). To illustrate, the expected SPP module 314 of the data processor 206 may determine severity of a trend deviation in data values corresponding to the SPP drilling parameter with respect to variations in data values of the TSPM drilling parameter.

In some example embodiments, the SPP, TSPM and Lookback Window are provided to the expected SPP module 314 as inputs. Further, in some example embodiments, Rig State Activity Code from the rig state processor 208 and output of the Value Change module 312 are provided as inputs to the expected SPP module 314. The expected SPP module 314 may generate/store outputs including Expected Stand Pipe Pressure, Difference between Expected and Current Stand Pipe Pressure values, and percentage Difference between Expected and Current Stand Pipe Pressure values.

During operation, the expected SPP module 314 may analyze the Current Rig State to determine whether current operations are of "Drilling or "Not Drilling." For example, the expected SPP module 314 may determine whether current operations are of "Drilling or "Not Drilling" based on the Rig State Activity Code from the rig state processor 208 that provides a standard indication of a drilling activity. The expected SPP module 314 may also analyze the outputs from the Value Change module 312 for current output marker corresponding to TSPM and SPP data. The expected SPP module 314 may also analyze the outputs from the Value Change module 312 for any instance and type of an "Increasing" or "Decreasing" marker output over the time interval specified by the "Lookback Window" provided by an end-user and indicate whether or not a "recent" change in TSPM has occurred and whether the change was of "Increase" or "Decrease." Analysis for instances and type of "Increasing" or "Decreasing" marker output allows for determining whether or not a "recent" change in TSPM has occurred and whether this change was of "Increase" or "Decrease."

The expected SPP module 314 calculates Expected SPP based on the current TSPM value, TSPM value at a previous time period and the Stand Pipe Pressure corresponding to the TSPM value at the previous time period based on Equation (4).

$$SPP_{expected} = SPP_{Previous}\left(\frac{TSPM_{Current}}{TSPM_{Previous}}\right)^{1.86} \quad \text{Equation (4)}$$

In Equation (4), a. $SPP_{expected}$ is a calculated value of SPP that would result from a change in TSPM.
b. "Current" and "Previous" values are the outputs of Signal Processing techniques applied on the data values corresponding to SPP and TSPM drilling parameters.
c. The term "Previous" refers to a point back in time from the current timestamp of the Onset Window plus the sample rate, i.e., if the Onset Window=30 sec, Sample Rate 5 sec, then the Previous Value would be at Current Timestamp−35 seconds.
d. The Onset Window is the end-user input variable provided to the Value Change module 310.

The expected SPP module 314 also calculates the difference and the percentage difference between the expected and current SPP values based on Equations (5) and (6), respectively.

$$SPPDelta = SPP_{expected} - SPP_{current} \quad \text{Equation (5)}$$

$$SPP\%\ \text{Change} = SPP_{Previous}\left(\frac{|SPPDelta|}{SPP_{expected}}\right)^{1.86} \quad \text{Equation (6)}$$

Figure 7:
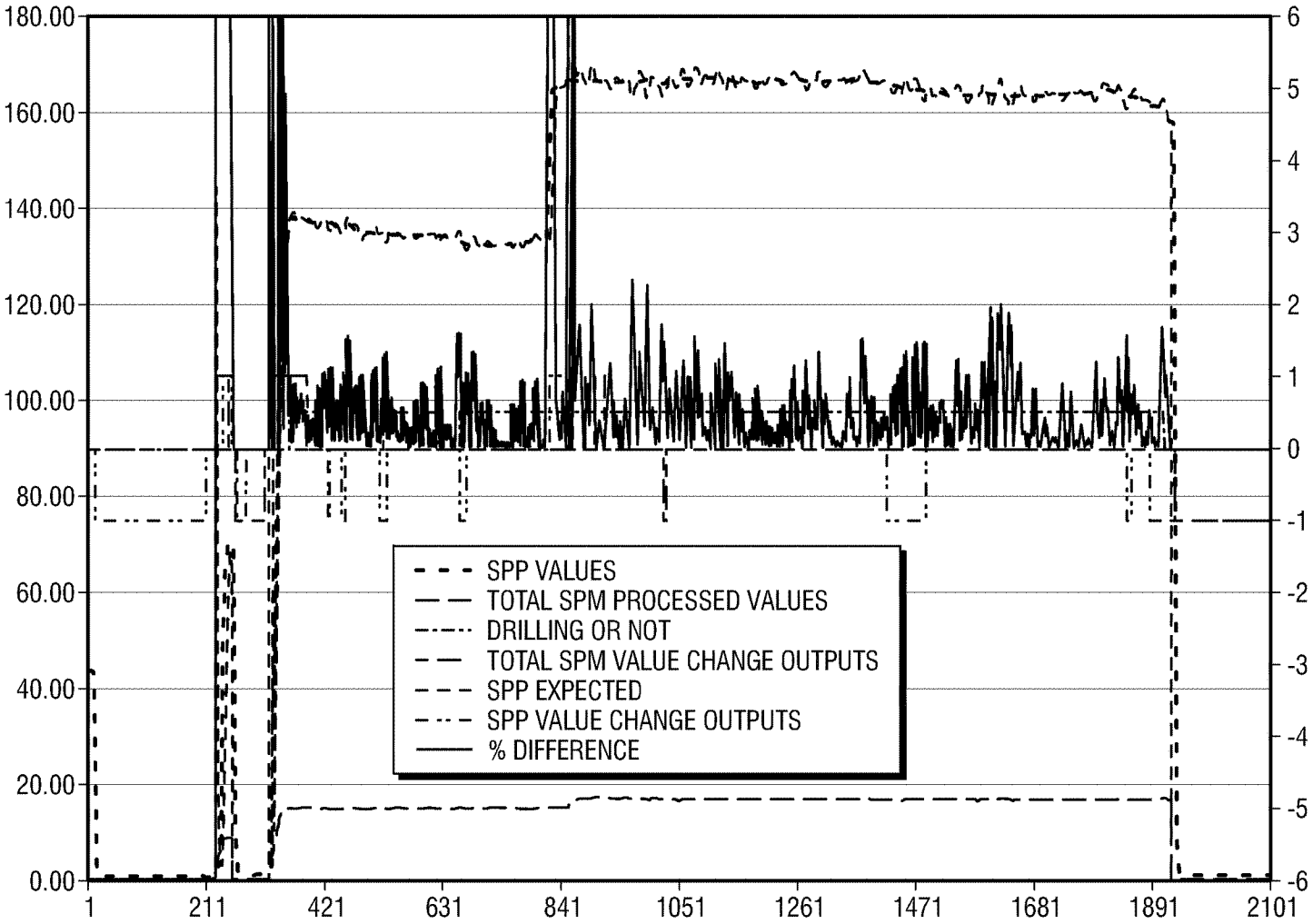
FIG. 7 illustrates a plot of output values of the expected stand pipe pressure module of the data processor of FIG. 3 according to an example embodiment.

FIG. 7 illustrates a plot of output values of the expected stand pipe pressure module 310 of FIG. 3 according to an example embodiment.

In some example embodiments, the data processor 206 estimates rates of change of rates of change (i.e., acceleration). In particular, the acceleration module 316 may determine (e.g., calculate) the rate of change of the current rate of change of data values of a particular parameter between two points in time. To illustrate with respect to the BP drilling parameter, the acceleration module 314 may receive Sample Rate, Median Window from the slope module 310, and Offset, which is the same as the Offset provided to the slope module 310. Based on these inputs, the acceleration module 316 may output (1) "Instantaneous Velocity," which is the rate of change between the current and previous data values corresponding to the BP parameter based on current sample rate; (2) "Average Velocities," which is the average of Instantaneous Velocity outputs over two ranges of time; and (3) "Acceleration," which is a calculated rate of change based on a rate of change (Instantaneous Velocity) at a previous point in time.

The instantaneous Velocity, $v_t$, is determined according to Equation (7).

$$v_t = \left(\frac{BP_t - BP_{t-samplerate}}{\text{Sample Rate}}\right) \quad \text{Equation (7)}$$

Average Velocity over Offset equals Average of Instantaneous Velocities ($V_t$) over the Offset, and Average V over median window equals Average of Instantaneous Velocities ($V_t$) over the Median Window. The acceleration module 316 determines of from the data values corresponding to the BP according to Equation (8).

$$a = \left(\frac{2}{Offset^2}\right) \times ((BP_t - BP_{t-offset}) - (v_{t-offset} * \text{Offset})) \quad \text{Equation (8)}$$

In Equation (8), a=Acceleration;

BP=block position (BP) from the data conditioner 204;

t=current time;

Offset=Offset (time in seconds) used in the slope module 310; and t−offset=current time−offset time.

In some example embodiments, the data processor 206 includes a lag time lookup module 318 align causally related drilling parameters based on their corresponding sets of data values. To illustrate, a lag time look-up formula may be used to determine the look-back time or lag time for a set of data values corresponding to a particular drilling parameter. For example, the lag time lookup module 318 may be used to look back on value changes of the TSPM drilling parameter determined by the slope module 310 or the value change module 312 described above.

To illustrate with respect to Bit Depth drilling parameter, the lag time lookup module 318 may calculate "Lag Time" based on current Bit Depth indicated by the sets of data values in the raw data and conditioned by the data conditioner module 204. For example, the lag time lookup module 318 may calculate "Lag Time" according to Equation (9).

$$\text{Lag Time} = \left(\frac{\text{Bit Depth(ft)}}{1000}\right) \times 2 \text{ seconds} \quad \text{Equation (9)}$$

In Equation (9), the time, in number of seconds, can be configurable and may not always be 2 seconds.

In some example embodiments, the alarm generator 210 may generate a number of alarms based on the outputs of the data processor 206. As illustrated in FIG. 3, some alarms are related to one or more drilling parameters and other alarms are related one or more other or overlapping drilling parameters. Example alarms generated by the alarm generator module include SPP, Flow Out, Tank Gain, and Drilling Break. To illustrate, the Drilling Break alarm indicates an increase in a rate of penetration (ROP) that occurs without a corresponding increase in WOB. As another example, the Flow Out alarm indicates an increase in flow out that occurs without a corresponding increase in TSPM. In general, TSPM corresponds to a sum of individual SPM parameters. In some example embodiments, each one of the alarms SPP, Flow Out, Tank Gain, and Drilling Break may include multiple alarms that provide alerts about different conditions based on the same inputs provided to the particular alarm module 320, 322, 324, 326. For example, a module 320 of the alarm generator 210 generates the SPP alarm based on a combination of a drilling indication from the rig state generator 208, one or more outputs from the Expected SPP module 318, and one or more outputs from the value change module 312.

In some example embodiments, one or more of the modules 310, 312, 314, 316, 318 may be omitted or may operate on different drilling parameters than shown in FIG. 3. Further, causal relationships between drilling parameters other than described above may be used in the generation of alarms.

Figure 8A:
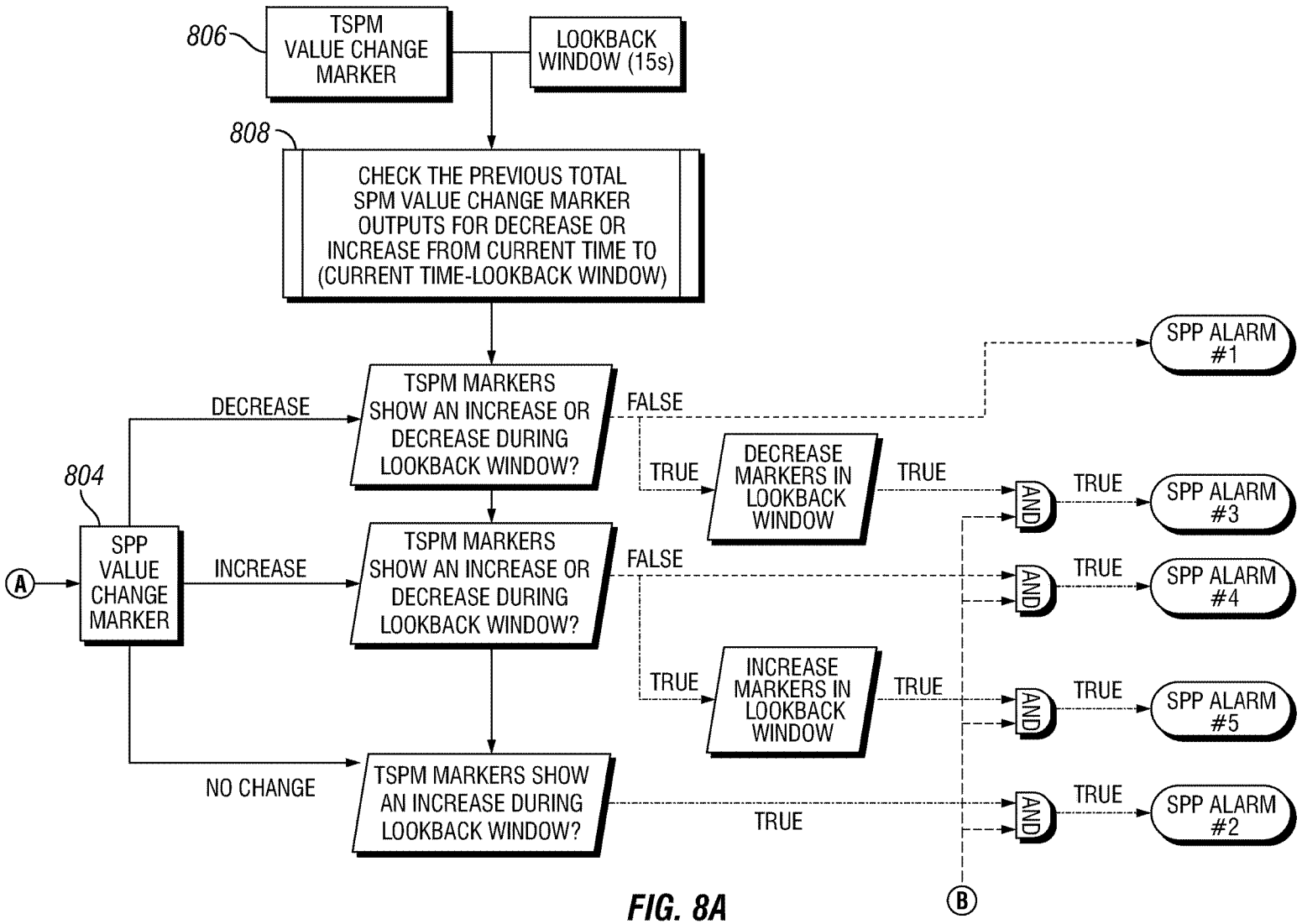
FIGS. 8A and 8B illustrate a flow chart showing generation of a SPP alarm based on outputs of the data processor of FIGS. 2 and 3 and user provided inputs.
Figure 8B:
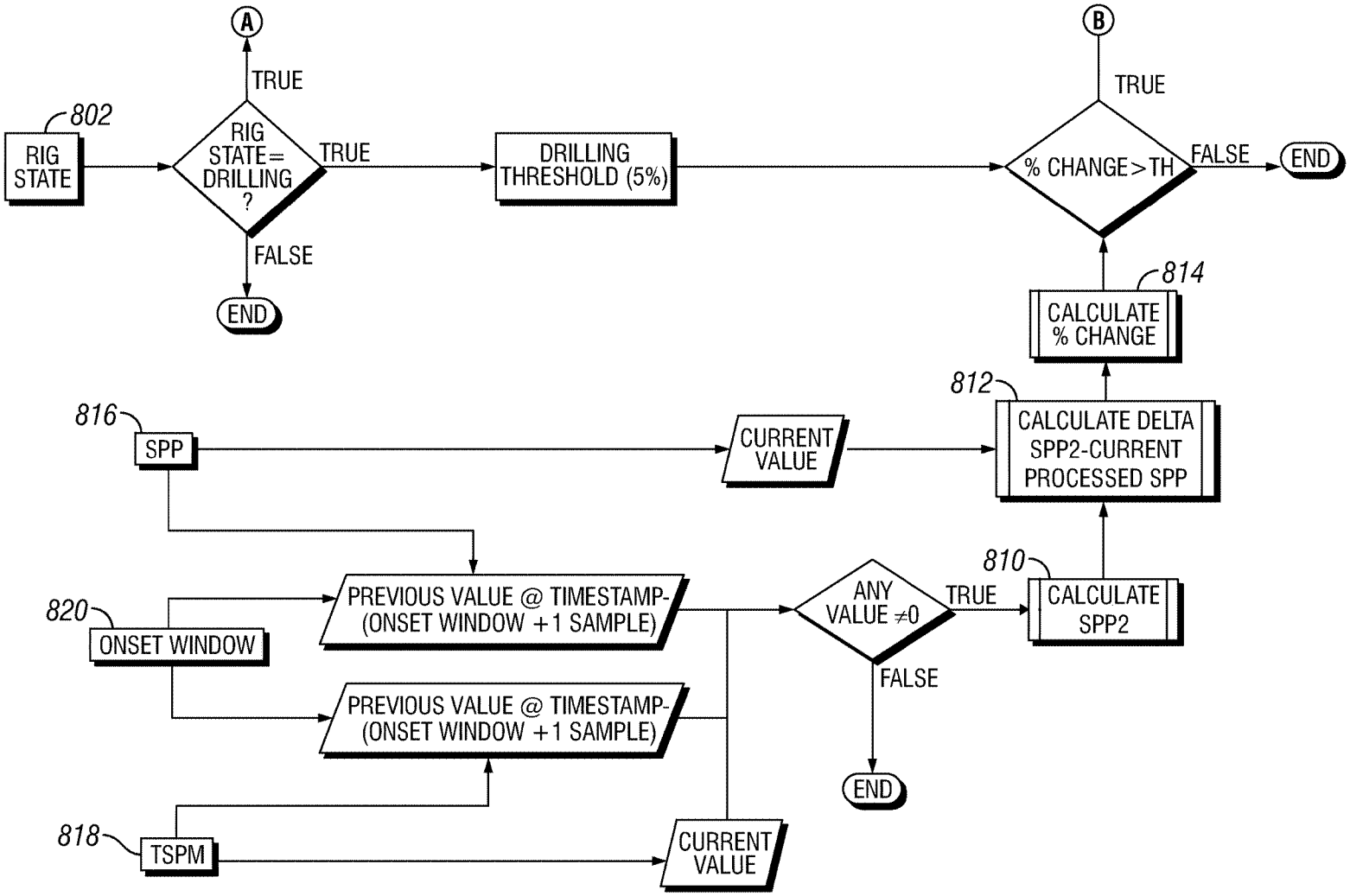

A flow chart showing generation of the SPP alarm based on outputs of modules of the data processor 206 and user provided inputs is shown in FIGS. 8A and 8B according to an example embodiment. In FIGS. 8A and 8B, a number of SPP alarms are generated based on causal relationship between TSPM and SPP drilling parameters. Five of the possible alarms that may be generated are shown in FIGS. 8A and 8B. SPP Alarm #1 indicates a decrease in SPP with no change in TSPM. SPP Alarm #2 indicates no change in SPP with an increase in TSPM and a percentage change in SPP that is greater than an end-user defined threshold. SPP Alarm #3 indicates a decrease in SPP with a decrease in TSPM and a percentage change in SPP that is greater than the end-user defined threshold. SPP Alarm #4 indicates an increase in SPP with no change in TSPM and a percentage change in SPP that is greater than the end-user defined threshold. SPP Alarm #5 indicates an increase in SPP with increase in TSPM and a percentage change in SPP that is greater than the end-user defined threshold.

At 802, a rig state activity code is provided, for example, by the rig state generator 210 of FIG. 3, to indicate whether a drilling rig is actively drilling or not drilling. At 804, an SPP Value Change Marker is provided, for example, by the value change module 312 FIG. 3 indicating "Increasing", "Decreasing," or "No Change".

At 806, a TSPM Value Change Marker is provided, for example, by the value change module 312 FIG. 3. At 808, previous TSPM Value Change Marker outputs are checked for decrease or increase between the current time and current time minus Lookback Window provided by an end-user. To illustrate, at 808, analysis of previous Value Change Markers for TSPM within a specified Lookback Window in time is performed. At every timestamp, an instance and type of a TSPM Value Change Marker from the current timestamp back in time to an end-user specified "Lookback Window" (for example, in seconds) is identified, which indicates whether or not a "recent" change in TSPM has occurred and whether the change was an "Increase" or a "Decrease."

At 814, a percentage in the difference between expected/calculated SPP and current SPP values is calculated based on the delta calculated at 812, which depends on the expected/calculated SPP (SPP2) determined at 810. In general, the percentage difference determined at 814 is determined in the manner described with respect to the expected SPP module 314 of FIG. 3. To illustrate, the data values corresponding to SPP and data values correspond to TSPM are provided at 816 and 818, respectively. The Offset Window provided at 820 is the same as the Offset Window provided to the value change module 312 of FIG. 3. In some example embodiments, some of the steps described above may be performed concurrently.

SPP Alarm #1 is generated if (a) a "Decreasing" SPP Value Change Marker currently exists; and (b) neither a "Decreasing" or "Increasing" TSPM Value Change Marker is present within the Lookback Window. SPP Alarm #2 is generated if (a) a "No Change" SPP Value Change Marker currently exists; (b) an "Increasing" TSPM Value Change Marker is present within the Lookback Window; and (c) the calculated SPP percentage change is greater than the user provided threshold (e.g., 5%). SPP Alarm #3 is generated if (a) a "Decreasing" SPP Value Change Marker currently exists; (b) a Decreasing" TSPM Value Change Marker is present within the Lookback Window; and (c) the calculated SPP percentage change is greater than the user provided threshold. SPP Alarm #4 is generated if (a) an "Increasing" SPP Value Change Marker currently exists; (b) neither a "Decreasing" or "Increasing" TSPM Value Change Marker is present within the Lookback Window; and (c) the calculated SPP percentage change is greater than the user provided threshold. SPP Alarm #5 is generated if (a) an "Increasing" SPP Value Change Marker currently exists; (b) an "Increasing" TSPM Value Change Marker is present within the Lookback Window; and (c) the calculated SPP percentage change is greater than the user provided threshold.

In general, the apparatus, system, and method described above with respect to FIGS. 1-8 provide alerts about abnormal drilling conditions based on trends and relationships between different drilling parameters. The generated alarms may result in prevention of drilling related incidents. The removal of outlier data values and noise in sets of data values corresponding to drilling parameters allows for generation of reliable alarms. The apparatus, system, and method reduce subjectivity in the generation of alarms and provide for consistency in the generation of alarms. The generated alarms may be provided to drilling engineers at drilling sites or may be provided to monitoring personnel in various forms including via a display.

Although some embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A method of monitoring drilling conditions, the method comprising:

acquiring raw data from drilling equipment;

conditioning, by a data conditioning module, the raw data to generate conditioned data, wherein conditioning the raw data comprises removing outlier data values and/or filtering out noise;

processing, by a data processor, the conditioned data to generate output values for use in alarm generation, wherein processing the conditioned data comprises:

determining a slope of a first set of data values of the conditioned data with respect to a regression length of time, the first set of data values corresponding to a regression length of time; and determining whether a difference between the slope of the first set of data values and a median slope determined over a median window of time exceeds a threshold, wherein the median slope is a middle value of a set of slope values over the median window of time; and generating, by an alarm generator, an alarm based on the output values to indicate an abnormal drilling condition.

2. The method of claim 1, further comprising determining a rig state to generate a rig state indicator value that indicates whether a drilling rig is drilling, wherein the alarm is generated based on the rig state indicator value.

3. The method of claim 1, wherein acquiring the raw data from the drilling equipment comprises receiving the raw data from one or more sensors used in drilling operations.

4. The method of claim 3, wherein the one or more sensors sense a wellbore pressure and a stroke rate for pumping drilling mud.

5. The method of claim 1, wherein conditioning the raw data further comprises performing a deadband operation to reduce unwanted variations in filtered data produced by performing filtering out noise.

6. The method of claim 1, wherein the raw data comprise data sets representing stand pipe pressure (SPP), total strokes per minute (SPM), block position (BP), weight on bit (WOB), tank volume (TV), and/or flow out (FO).

7. The method of claim 1, wherein the alarm comprises a drilling break alarm indicating an increase in a rate of penetration (ROP) that occurs without a corresponding increase in weight on bit (WOB).

8. The method of claim 6, further comprising compensating for lag time between causally related data sets of the conditioned data.

* * * * *